US006669997B2

(12) United States Patent
Luan et al.

(10) Patent No.: US 6,669,997 B2
(45) Date of Patent: Dec. 30, 2003

(54) ACOUSTO-IMMERSION COATING AND PROCESS FOR MAGNESIUM AND ITS ALLOY

(75) Inventors: Ben Li Luan, London (CA); Joy Elizabeth Gray, Fredericton (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 10/105,223

(22) Filed: Mar. 26, 2002

(65) Prior Publication Data

US 2003/0203232 A1 Oct. 30, 2003

(51) Int. Cl.[7] ..... B05D 1/18; B05D 1/36; B05D 1/12; B05D 1/28

(52) U.S. Cl. ..... 427/601; 427/600; 427/405; 427/435; 427/436; 427/437; 427/438; 427/429; 427/190; 427/191; 205/188

(58) Field of Search ..... 427/600, 601, 427/405, 435, 436, 437, 438, 443.1, 429, 190, 191; 205/188

(56) References Cited

U.S. PATENT DOCUMENTS

| | | | | |
|---|---|---|---|---|
| 2,728,720 A | | 12/1955 | De Long et al. | |
| 3,439,188 A | * | 4/1969 | Glover et al. | 205/148 |
| 3,656,225 A | * | 4/1972 | Bereza | 228/121 |
| 3,672,964 A | | 6/1972 | Bellis et al. | |
| 4,011,055 A | * | 3/1977 | Hill et al. | 428/634 |
| 4,349,390 A | | 9/1982 | Olsen et al. | |
| 6,068,938 A | | 5/2000 | Kato et al. | |

FOREIGN PATENT DOCUMENTS

| | | | |
|---|---|---|---|
| JP | 59050194 A2 | 3/1984 | C25D/5/30 |
| JP | 61067770 A2 | 4/1986 | C23C/18/18 |
| JP | 2254179 A2 | 10/1990 | C23C/28/02 |
| JP | 10081993 A2 | 3/1998 | C25D/5/34 |
| WO | WO 02/06561 A2 | 7/2001 | C23C/18/00 |
| WO | WO 200206561 A2 * | 1/2002 | C23C/18/00 |

OTHER PUBLICATIONS

Olsen, "Plating of Magnesium High Pressure Die Castings", Transactions of the Institute of Metal Finishing, vol. 58, pp. 29–32, 1980.*

Y. Sakata, Electorless Nickle Nickel Plating Directly on Magnesium Alloy Die castings, 74$^{th}$ AESF Technical Conference, (1987) 15.

D. Crotty, C. Stinecker, B. Durkin, *Products Finishing*, 60(1996) 44.

W.A. *Fairweather*, Transactions, 75 (1997) 113.

L.Brown, *Finishing*, 18 (1994) 22.

P.J. Corely, *Finishing*, 19 (1995) 26.

R.G. Golovchanskya et al., *Protection of Metals*, 6 (1970) 565.

L.F. Spencer, *Metal Finishing*, 68 (1970) 32.

L.F. Spencer, *Metal Finishing*, 69 (1971) 43.

Hydro Magnsium, *Corrosion and Finishing of magnesium allows*, http://hydro.com/magnesium(No date).

J. Chen et al., *Journal of Allows and Compounds*, 280 (1998) 290.

J.K. Dennis et al., Transactions, 63 (1985) 81.

A. L. Olsen, Transactions, 58 (1980) 29. A. L. Olsen, S. T. Halvorsen Method of the electrolytical metal coating of magnesium articles, US4349390, (1980).

* cited by examiner

*Primary Examiner*—Michael Barr
(74) *Attorney, Agent, or Firm*—Kathleen E. Marsman; Borden Ladner Gervais LLP

(57) ABSTRACT

A process for coating an object formed of magnesium or a magnesium alloy comprising the steps of: immersion coating the object in a sonicated bath to form an undercoat and topcoating the object to form a topcoat. When desirable to protect against topcoat failure, the undercoat may be equally noble or more noble than the topcoat. If topcoat failure is not a concern, the nobility of the topcoat relative to the undercoat need not be considered. The process promotes uniform coating of a magnesium and its alloys.

18 Claims, 2 Drawing Sheets

ACOUSTO-IMMERSION COATING AND PROCESS FOR MAGNESIUM AND ITS ALLOY

FIELD OF THE INVENTION

The present invention relates to a chemical process for coating magnesium and its alloys, and to a coating so formed.

BACKGROUND OF THE INVENTION

With the increasing awareness of fuel consumption and human ecology, a global commitment has been made to reduce vehicle mass through application of lightweight materials. Magnesium is the lightest structural metal with the highest specific strength and is the eighth most abundant element on the earth. Many researchers and developers have looked to magnesium to provide a solution for vehicular mass reduction for the automotive, aircraft and aerospace industries. However, challenges exist owing to its low corrosion and wear resistance. To achieve the necessary mass reductions, various coating technologies have been applied to enhance the corrosion and wear resistance of magnesium alloys. To date, no coating technology provides a solution that satisfies the combination of functionality, cost, scalability and environmental concerns. Development of a high volume, environmentally friendly, low cost and mass production scaleable coating process to increase the corrosion and wear resistance of magnesium remains a challenge. Conventional coating technologies are briefly summarized below.

Conversion coatings, the most commonly used type of coatings, contain hexavalent chromium, a highly toxic carcinogen. Conversion coatings alone do not provide sufficient corrosion and wear protection for magnesium alloys in harsh service conditions. Conversion coatings are generally used as an undercoat.

Anodizing is a process that does not provide sufficient corrosion resistance without further sealing because the coatings produced are comprised of a thick porous layer over a thin continuous barrier layer. The coatings produced are brittle insulating ceramic materials, which limits their use in applications where electrical conductivity or load-bearing properties are necessary. High energy consumption is another drawback to this process.

Gas-phase deposition processes require large capital investment and cannot uniformly coat complex shapes due to their line of sight nature. The corrosion, adhesion and wear properties of these coatings on magnesium alloys have not been well documented.

Organic coatings alone do not have sufficient corrosion and wear resistance to protect magnesium for use in harsh service conditions. They are typically used as top-coats and must be applied in multiple layers due to difficulties in achieving uniform pore-free coatings.

Electrochemical coating processes are available for plating of magnesium alloys. These processes are alloy specific and do not work well on alloys with high aluminum content. Direct electroless nickel plating and zinc immersion are two types of electrochemical coating processes.

Direct electroless nickelplating is limited by the short lifetime of the plating baths, the toxicity of chemicals used in the pretreatment process and the narrow operating window required for optimum coatings.

Direct electroless nickel plating comprises a pretreatment process in which electroless nickel is plated directly onto magnesium alloy AZ91 die castings, developed by Sakata et al.(1). In general the pretreatment is as follows:

Pretreat→Degrease→Alkaline Etch→Acid Activation→Alkaline Activation→Alkaline Electroless Nickel Strike→Acid Electroless Nickel Plating.

This process has been criticized (2) for using an acid electroless nickel treatment that can result in corrosion of the underlying magnesium if any pores are present in the nickel strike layer. A simpler process has been developed by PMD (U. K.) Limited (see references 3, 4, 5). The basic sequence of this pretreatment is as follows:

Pretreat→Alkaline Clean→Acid Pickle→Fluoride Activation→Electroless Nickel Plating.

The authors determined that the etching, conditioning and plating conditions had a large effect on the adhesion obtained. An insufficient etch or fluoride conditioning resulted in poor adhesion. It was also determined that using hydrofluoric acid for conditioning led to a wide plating window while ammonium bifluoride resulted in a much narrower (pH 5.8–6.0 and temperature=75–77° C.) window for acceptable adhesion. The chromic acid treatment was found to heavily etch the surface and leave behind a layer of reduced chromium. The fluoride conditioning was found to remove chromium and control the deposition rate by passivating the surface. The passivating effect of fluoride was also exploited in the plating of magnesium alloy MA-8 (6). In this case the nickel plating bath contained fluoride to inhibit corrosion of the substrate during plating. The authors report strong adhesion of the nickel film however, the bath life is too short to be industrially applicable. The addition of a complexing agent, glycine, was shown to improve the stability of the plating bath. Another proposed process (7) involves treatment of the sample with a chemical etching solution containing pyrophosphate, nitrate and sulfate, avoiding the use of toxic chromium ions. The process sequence is as follows:

Chemical Etching→Fluoride Treatment→Neutralization→Electroless Nickel Plating.

The electroless nickel plating bath does not contain any chloride or sulfate. The plated samples achieved have high adhesion and corrosion resistance. One obstacle to coating magnesium with nickel is that most conventional nickel plating baths are acidic and can attack or corrode the magnesium surface. This problem has been addressed by the development of an aqueous acidulated nickel bifluoride electroplating bath that contains a polybasic acid (8). This bath has been shown to not corrode magnesium.

Zinc Immersion Processes (see references 9*a* and 9*b*) are limited by the poor uniformity of the zinc undercoating produced as well as the need for a copper cyanide strike prior to any further plating. The chemicals required for zinc immersion processes are extremely toxic. The zinc immersion pretreatment process has been criticized for the precise control that is required to ensure adequate adhesion. In many cases non-uniform coverage of the surface is seen with spongy non-adherent zinc deposits on the intermetallic phase of the base alloys (1). The copper cyanide strike that must follow has also been criticized for a number of reasons (1). The first is that it is an electroplating process, which means that it is more difficult to coat complex shapes. Copper deposits slowly in the low current density areas, which allows attack of the zinc by the plating solution. This in turn allows attack on magnesium by the plating solution resulting in non-adherent copper depositing by displacement directly on the magnesium surface. The deposits in these areas are porous and have poor corrosion resistance. The second criticism levelled at the copper cyanide plating process is the high cost treatment of waste generated by the use of a cyanide containing bath. A patented methodology (10) attempts to improve this process by eliminating the copper cyanide step from the pretreatment process. The copper cyanide electroplating is replaced by a zinc electroplating step followed by copper deposition from a pyrophosphate bath after the zinc immersion. This patent claims that by creating a uniform zinc film of at least 0.6 micrometers in thickness, adherent plating films can be obtained on any magnesium alloy using the disclosed process. The zinc electroplating step can occur simultaneously with the zinc immersion process or in a separate step. The process is as follows:

Degrease→Alkaline Clean→Acid Clean→Activation→Zinc Immersion→Zinc Electroplate→Copper Plating.

A number of processes based on the zinc immersion pretreatment process have been developed. The three main processes are the Dow Process, the Norsk-Hydro process and the WCM Canning Process (1, 11). One criticism of all of these processes is that they do not produce good deposits on magnesium alloys with an aluminum content greater than 6–7% (12). The general pretreatment sequence for each of these is outlined below for comparison (1, 11).

Dow Process:

Degrease→Cathodic Cleaning→Acid Pickle→Acid Activation→Zincate→Cu Plate.

Norsk-Hydro Process:

Degrease→Acid Pickle→Alkaline Treatment→Zincate→Cu Plate

WCMProcess:

Degrease→Acid Pickle→Fluoride Activation→Zincate→Cu Plate

The Dow process was the first to be developed but has been shown to give uneven zinc distributions as well as poor adhesion in many cases. A modified version of the Dow process (13) introduces an alkaline activation following the acid activation step. This results in good adhesion of Ni—Au films on AZ31 and AZ91 alloys. The authors shortened the pretreatment time, which is important in a manufacturing setting. The Norsk-Hydro process has been shown to improve the quality of the zinc coating on AZ61 alloy in terms of adhesion, corrosion resistance and decorative appearance. Deposits of Cu—Ni—Cr, on samples pretreated with this process, have been shown to exceed the standards for outdoor use (see references 14*a* and 14*b*). Dennis et al. (11, 15) show that samples treated with both the Dow and Norsk-Hydro processes give porous zinc coatings and perform poorly in thermal cycling tests. It was found that the WCM process resulted in the most uniform zinc film and was the most successful in terms of adhesion, corrosion and decorative appearance. However, preferential dissolution of magnesium rich areas on the alloys occurred with all 3 processes, which could limit the effectiveness of any of these pretreatment methods.

A similar process has been used as an undercoating for samples to be plated with a series of metals by electroless and electroplating techniques (16). A slight variation of the pretreatment uses a copper cyanide plating bath that contains a soluble silicate (17). Zinc immersion prior to tin plating of magnesium has also been explored (18). A magnesium alloy is treated with a conventional zinc immersion pretreatment and then zinc plated in an aqueous zinc pyrophosphate bath. Tin is subsequently plated to improve the tribological properties of the plated alloy.

As stated above, the disadvantages of the direct electroless nickel plating methodology include the short lifetime of the plating baths, the toxic chemicals used in the pretreatment process, and the narrow operating window required to achieve optimum coatings.

The zinc immersion process has the disadvantages of poor uniformity of the zinc undercoating, and the need for extremely toxic chemicals in the copper cyanide strike prior to any further plating.

A two-step coating process (19) was reported to be applicable for the coating of magnesium and its alloys: the first step is an immersion coating process and the second step is an electroless deposit as the topcoat. However, the claimed immersion process can only produce a semi-continuous coating, which is not preferable as a coating. The non-continuous nature of the coating will, in fact, accelerate the corrosion of magnesium rather than protecting it in the event of a topcoat failure. The process described in reference 19 was only exemplified with aluminium rather than on magnesium alloys.

A need exists for a process capable of providing a uniform coating on magnesium or magnesium alloy materials having complex geometric shapes. Further, a need exists for such a process that minimizes the use of toxic chemicals and is not line-of-sight dependent.

SUMMARY OF THE INVENTION

It is an object of the present invention to provide a process for chemically coating magnesium and its alloys, which process obviates or mitigates at least one disadvantage of previous coating processes.

In a first aspect, the present invention provides a process for coating an object formed of magnesium or a magnesium alloy comprising the steps of: immersion coating the object in a sonicated bath to form an undercoat, and subsequently topcoating the object to form a topcoat, wherein the undercoat is more noble than or equally noble as the topcoat. The topcoating step may comprise electroless deposition, or any other known coating process. This aspect of the invention is particularly advantageous if there is potential for topcoat failure. If damage is done to the topcoat, exposure of the less reactive undercoat would not result in corrosion or reactivity of the undercoat.

In a further aspect, the present invention comprises a process for coating an object formed of magnesium or a magnesium alloy comprising the steps of: immersion coating the object in a sonicated bath to form an undercoat, and topcoating the object. This aspect of the invention does not necessarily require a particular nobility gradient between the topcoat and the undercoat, provided that topcoat failure is unlikely to occur. For instance, where there is little likelihood of damage to the topcoat, the topcoat could be more noble than the undercoat.

The invention encompasses embodiments wherein the topcoating step is conducted using a process selected from the group consisting of electroless deposition, electroplating, brush plating, powder coating and a combination thereof.

According to embodiments of the invention, the object to be coated may be formed of a magnesium-based alloy, such as but not limited to the group consisting of AZ91, AM60, AZ31, WE54, ZE63, ZK21, and ZM21.

Further, the topcoat may comprise a metal selected from the group consisting of Ni, Ti, Mn, Al, Fe, Co, Zr, Mo, Nb and W. The topcoat may be a metal alloy or a metal composite.

Advantageously, the inventive process for coating magnesium and its alloys is not line-of-sight dependent and is therefore capable of providing uniform coatings on the entire surface of shaped objects having a complex geometry including sharp corners, edges and deep pockets.

Other aspects, features and advantages of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
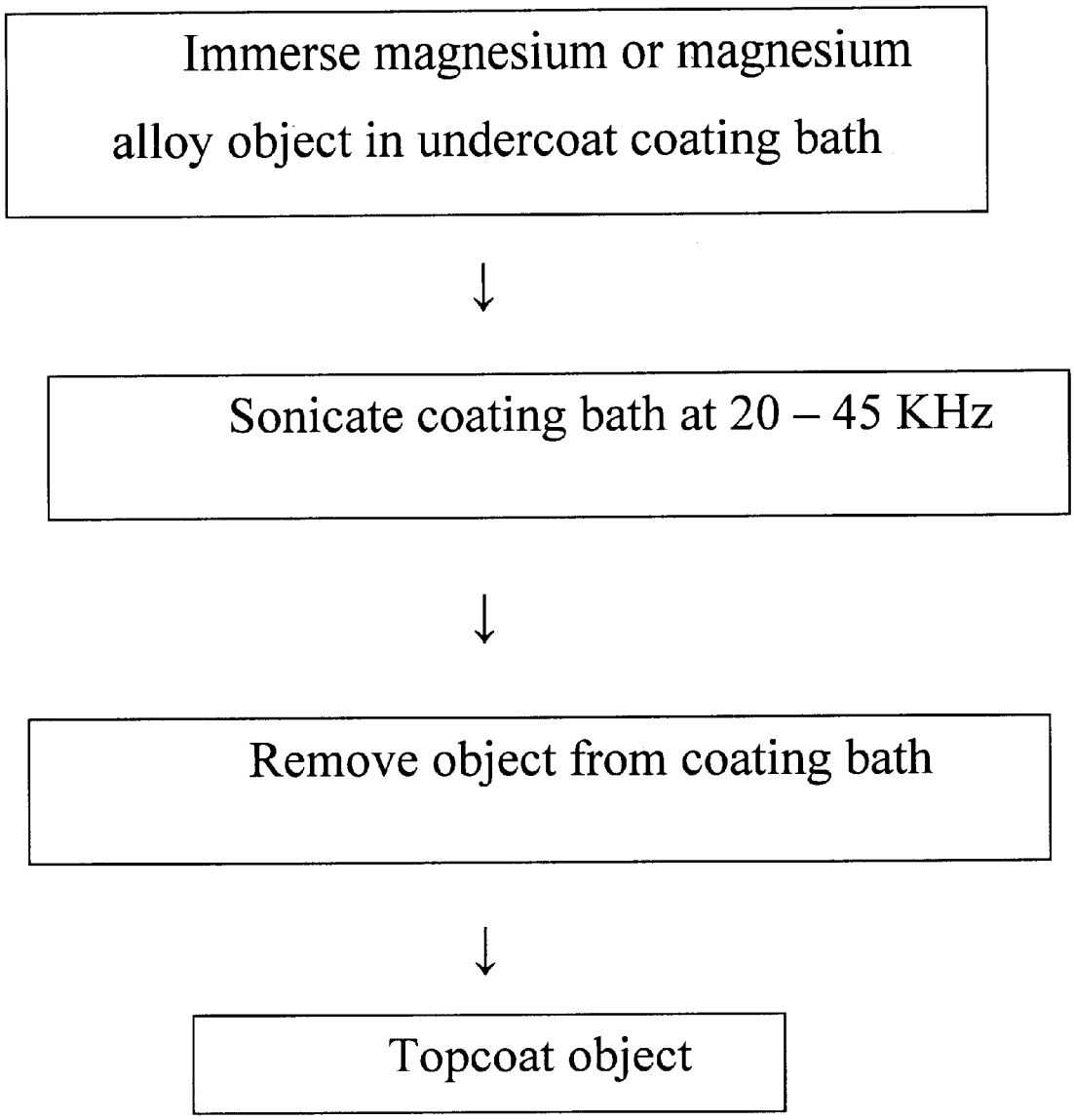
FIG. 1 is a flow diagram illustrating the process according to the invention.

Generally, the present invention provides a method and system for coating magnesium and magnesium alloys. The process employs a combination of an immersion coating step and a subsequent deposition step allowing uniform coatings on magnesium and its alloys for avoiding corrosion and improving wear protection. The potential applications of the process cover automotive, aircraft, aerospace, military and other areas where application of magnesium/alloys is needed.

The first step of the process is immersion coating which produces a continuous undercoat. The second step can be any other known deposition or coating processes such as electroless deposition, electroplating, etc., which provides a topcoat over the undercoat. The first step includes application of ultrasound (or "sonication") in the immersion coating. The composition of the undercoat may be more noble than or equally noble to the topcoat composition for those instances in which topcoat failure may be expected. If topcoat failure occurs, the undercoat would be exposed, but would be equal in reactivity to the topcoat. In those instances where topcoat failure is not at issue, a increasing nobility gradient between the topcoat and undercoat is not necessary, and the topcoat could be selected from compositions more noble than the undercoat.

By "more noble", it is meant a composition that is less reactive. For example, because copper is less reactive than magnesium, copper is said to be more noble than magnesium. The nobility of a metal, relative to another metal, can be determined by comparison of their electromotive force (EMF), a term for the electrochemical potential of a galvanic cell. A table that lists a series of half-cell reaction is called Eletromotive Force series (EMF series). A general EMF series can be given as: K, Ca, Na, Mg, Al, Mn, Zn, Cr, Fe, Ni, Sn, Pb, [H], Cu, Hg, Ag, Pt, Au, provided in order of an increasing nobility. For example, Pt and Au are normally referred to as noble metals, and elements from K to Ca are normally regarded as 'active' metals. Also, Al is more noble than Mg, Ni is more noble than Fe.

The inventive process reduces use of highly toxic chemicals such as hexavalent chromium and cyanides. This renders the process more environmentally friendly and reduces the exposure of workers to toxic chemicals.

The use of sonication (or "ultrasound" vibration) in the immersion coatingstep provides the advantage that the coating is applied uniformly to the surface of the object. Thus, the undercoating layer is formed continuously and evenly. Application of ultrasound during the immersion coating step improves the quality of the undercoat, effectively changing the nature of the undercoat, compared to prior art methods which provided semi-continuous or patchy undercoatings, into a continuous undercoat that can reliably protect the substrate.

The undercoat layer formed during the immersion coating step protects the chemically reactive magnesium substrate (from which the coated object is formed) from being attacked during subsequent coating processes. This layer protects the subsequent coating bath from becoming contaminated by the dissolution of magnesium and/or its alloys. The layer formed in the immersion coating step acts as a contingency layer in the event of a topcoat failure by preventing direct contact of the reactive magnesium with corrosive environments.

The layer formed in the immersion coating step comprises a material that is more noble than the topcoat, thus providing cathodic protection to magnesium/or its alloys. This is especially advantageous if the topcoat becomes cracked or scratched because the topcoat meritoriously provides protection of the coated object in the event of a topcoat failure. The corrosion of the undercoat could actually be accelerated by the topcoat if the undercoat is not more noble than the topcoat, through the process of galvanic corrosion, which effectively creates a galvanic effect between adjacent layers, leading to oxidation of the "anode" layer. Because the undercoat layer is more noble than the overcoat layer, the accelerated corrosion of the undercoat is avoided thus providing a continued protection to the magnesium component.

The process according to the invention is simplified and economical, and therefore enables cost-competitive production. The process has excellent scalability which makes it suitable for large scale mass production. The undercoat process features automatic stop when the substrate surface is entirely covered, which simplifies process control. The process does not involve the use of cyanides or chromium compounds. Elimination of these toxic chemicals results in an environmentally friendly coating process.

This process does not require highly sophisticated facilities, and has excellent scalability by simply enlarging or reducing the size of the solution container. This makes it a simple, cost-effective process for mass production of parts of any size.

Immersion coating is the deposition of a metallic coating on a substrate by chemical replacement from a solution of a salt of the coating metal. The reducing agent for the reduction of the coating metal is the substrate metal itself which is, in the present case, magnesium. The advantages of immersion coating are simplicity, the ability to deposit uniform coating in recesses and on the inside of tubing, low production cost, and excellent scalability for mass production.

A further advantage of the immersion coating step is that an "automatic stop" effect is inherent in the step, allowing immersion coating to produce only a thin layer of deposit, without the need for extremely accurate or labour-intensive timing of the step. In this step, deposition stops automatically as soon as the substrate surface is covered. While the properties of this thin coating might not be adequate as a final functional coating, the "automatic stop" effect, combined with the advantages mentioned allows for simple and precise process control. In practice, no control is needed with respect to when and how to stop the immersion coating process.

The immersion coating process is combined with a subsequent top coating process. The immersion coating acts as a protective layer for both the substrate and the subsequent coating process. It prevents the soft reactive magnesium substrate from being attacked by the subsequent coating process and prevents the coating bath from being contaminated by the dissolution of magnesium. As immersion coating produces only a thin layer of coating, the role of the topcoat is to provide sufficient mechanical, physical and chemical functionality. The top coating process can be electroless deposition, electroplating and any other suitable deposition processes.

The immersion coating step is acoustically assisted by including sonication during the step. Application of ultrasound encourages production of a continuous immersion undercoat, with uniformity unparalleled by prior art processes. During the immersion coating process, gas evolution from the immersion solution and substrate surface takes place simultaneously with the deposition of metallic atoms on the substrate surface. In prior art processes, a competitive adsorption on the substrate surface exists between the gas bubbles and the atoms to be deposited to capture the available "anchoring" sites. Deposition of metallic atoms is therefore restricted by competition from the gas bubbles, using prior art processes. In order to enhance the deposition process, it is favorable to remove gas bubbles from the surface as soon as they are generated without disturbing the anchoring of metallic atoms. According to the invention, it has been discovered that application of ultrasound is successful in removing gas bubbles without disturbing the anchoring of metallic atoms to the surface. It is believed that the oscillation of the deposition solution caused by the ultrasound is sufficient to remove the gas bubbles but does not disturb the anchoring array of metallic atoms.

Any sonication frequency in the ultrasound range may be used which effectively allows de-gassing of the surface of the object to be coated during the undercoating step. The inventors have found that sonication frequencies in the range of from about 20 KHz to about 45 KHz are effective. The frequency of 35 KHz is an effective frequency when applied to bath of about 10 to 20 liters in volume through vibration of the bath at this frequency.

Ultrasound may be applied during the immersion coating step by either vibrating the bath container at the selected frequency, by inserting a sonicating probe into the bath, or by nesting a bath within a vibrating chamber or outer bath containing a liquid, for example water.

The duration of the immersion coating step may extend from minutes to hours, such as from 5 minutes to 3 hours, for example, 30 minutes. Because an automatic stop is observed in the present method, the length of time spent by an object to be coated within the immersion coating would not necessarily change the outcome of the step with respect to uniformity or coating thickness.

The process outlined in FIG. 1 illustrates the basic process according to the invention wherein an object to be coated is immersed, the coating bath is subject to sonication at 20–45 Hz, the object is removed from the coating bath, and is topcoated.

The invention is illustrated by the following examples.

EXAMPLE 1

An AZ91 magnesium alloy was used as the substrate. The material was supplied by LUNT Magnesium Die Casting, Inc.

The process starts with suitable pretreatment of the substrate, including degreasing and acid activation. The wettability of the surface is significantly enhanced during the pretreatment process. This, in turn, enhances the adhesion of the subsequent coating.

Degreasing of the substrate was conducted in a sodium carbonate solution under the following conditions: $Na_2CO_3$: 25 g/L; temperature: 60° C.; and degreasing time: 20 minutes.

Acid activation was then conducted in a solution with the following composition and operating conditions: $NH_4HF_2$: 100 g/L; $H_3PO_4$: 200 mL/L; temperature: 25° C.; and activation time: 1 minute.

Immersion coating was conducted in a solution described as follows: $CuSO_4$-$5H_2O$ (g/L): 125; HF (mL/L): 100; temperature: 25° C.; and immersion time: 5 minutes.

Sonication was applied during the immersion coating process. The Lab-Line Aquawave™ Ultrasonic Cleaner (Melrose Park, IL, 9333) with variable frequency was used to impart vibration on the bath. The frequency used was 35 KHz. Electroless deposition was subsequently applied on the immersion Cu coated AZ91 substrate. The deposition was conducted as follows: $NiSO_4.6H_2O$: 30 g/L; $NaH_2PO_2.H_2O$: 20 g/L; $CH_3COONa$: 20 g/L; pH: 4.5; temperature 75° C.; deposition time: 1 hour.

Figure 2A:
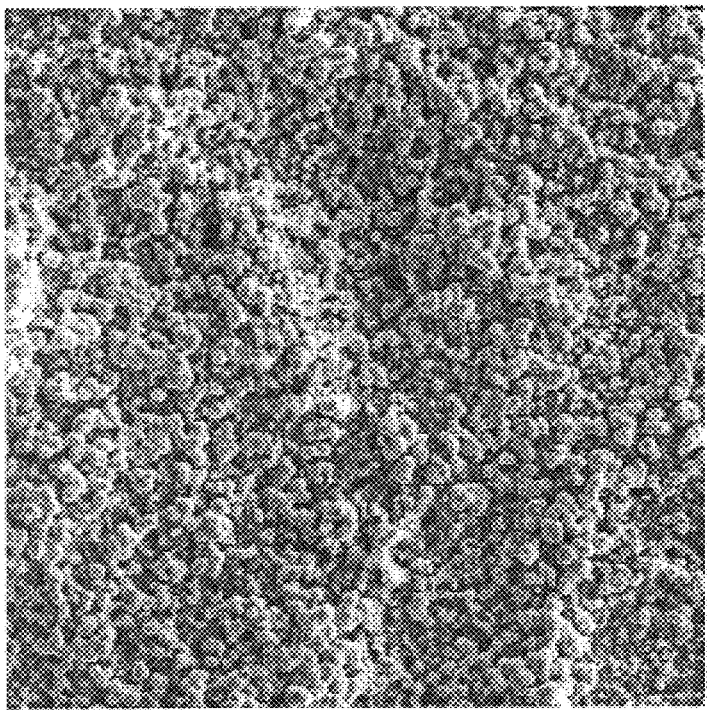
FIG. 2A is a scanning electron microscope (SEM) image of a surface resulting from an immersion Cu coating without sonication. Holes and patches of deposit can be observed on the surface.
Figure 2B:
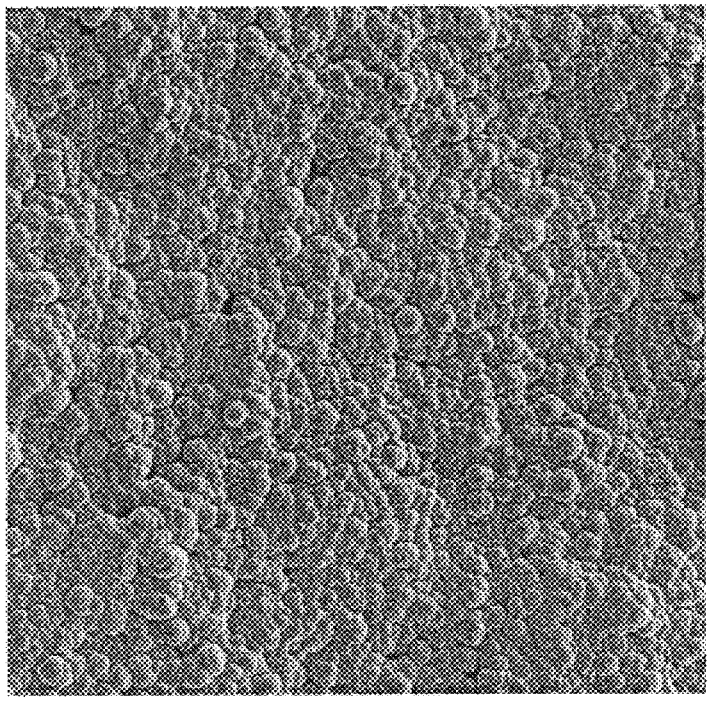
FIG. 2B is a scanning electron microscope (SEM) image of a surface resulting from an immersion Cu coating according to the invention prepared using sonication. The improved density and uniformity of the coating can be observed and contrasted with that of FIG. 2A.

FIGS. 2A and 2B show Scanning Electron Microscope (SEM) images for immersion Cu coating, and illustrate a comparison of a surface prepared without sonication (FIG. 2A) to a surface prepared using sonication (FIG. 2B). Both SEM images were collected at a magnification of ×500.

FIG. 2A shows an alloy surface coated without sonication, and illustrates holes and patches of the deposit on the surface. The one on the right is with sonication and the coating is dense. The surface shown in FIG. 2B was prepared according to this example, consistent with the invention, and illustrates a uniform coating of the alloy, with a dense coating, and without patchy areas.

EXAMPLE 2

Degreasing, acid activation and immersion coating were conducted as described in Example 1. Nickel electroplating was then applied in a conventional Watts bath as given as follows: $NiSO_4.6H_2O$: 225 g/L; $NiCl_2.6H_2O$: 30 g/L; $H_3BO_3$: 58 g/L; pH: 2; current density: 500 A/m$^2$; and deposition time: 1 hour.

The comparison of immersion coated samples with and without sonication resulted in observations similar to those shown in Example 1. For both Examples 1 and 2, samples prepared without sonication experienced immediate onset of corrosion during subsequent electroless nickel (Example 1) and electroplating (Example 2), owing to the discontinuity of the undercoat. Thus, in each example, the benefit of sonication is clearly illustrated.

The above-described embodiments of the present invention are intended to be examples only. Alterations, modifications and variations may be effected to the particular embodiments by those of skill in the art without departing from the scope of the invention, which is defined solely by the claims appended hereto.

References

1. Y. Sakata, Electroless Nickel Plating Directly on Magnesium Alloy Die castings, 74$^{th}$ *AESF Technical Conference*, (1987) 15.

2. D. Crotty, C. Stinecker, B. Durkin, *Products Finishing*, 60 (1996) 44.

3. W. A. Fairweather, *Transactions*, 75 (1997) 113.

4. L. Brown, *Finishing*, 18 (1994) 22.

5. P. J. Corley, *Finishing*, 19 (1995) 26.

6. R. G. Golovchanskaya, L. P. Gavrilina, T. A. Smirnova, N. T. Kudryavtsev, *Protection of Metals*, 6 (1970) 565.

7. JP 61067770 (1986). O. Toshinobu, E. Chiyoko, S. Yuji, Plating method of magnesium and magnesium alloy.

8. U.S. Pat. No. 2,728,720, (Dec. 27, 1955) H. K. DeLong, Method of producing an electroplate of nickel on magnesium and the magnesium-base alloys.

9(*a*). L. F. Spencer, *Metal Finishing*, 68 (1970)

9(*b*). L. F. Spencer, *Metal Finishing*, 69 (1971) 43.

10. U.S. Pat. No. 6,068,938 (May 30, 2000) J. Kato, W. Urushihara, T. Nakayama, Magnesium based alloys article and a method therof.

11. J. K. Dennis, m. K. Y. Y. Wan, S. J. Wake, *Transactions*, 63 (1985) 74.

12. Hydro Magnesium, Corrosion and finishing of magnesium alloys, http://hydro.com/magnesium.

13. J. Chen, D. H. Bradhurst, S. X. Dou, H. K. Liu, *Journal of Alloys and Compounds*, 280 (1998) 290.

14(*a*). A. L. Olsen, *Transactions*, 58 (1980) 29.

14(*b*). U.S. Pat. No. 4,349,390 (Sep. 14, 1982) Olsen, S. T. Halvorsen, Method for the electrolytical metal coating of magnesium articles.

15. J. K. Dennis, m. K. Y. Y. Wan, S. J. Wake, *Transactions*, 63 (1985) 81.

16. JP 2254179 (1990) M. Yoshio, Y. Kenichi. Formation of plating film on magnesium alloy.

17. JP 59050194 (1984) K. Hidekatsu. Method for plating aluminum, aluminum alloy, magnesium, magnesium alloy, zinc or zinc alloy.

18. JP 10081993 (1998) O. Mikio. Method for plating magnesium alloy.

19. U.S. Pat. No. 3,672,964 (Jun. 27, 1972) H. E. Bellis. Plating on aluminum, magnesium or zinc.

What is claimed is:

1. A process for coating an object formed of magnesium or a magnesium alloy comprising the steps of:

immersion coating the object in a sonicated bath to form an undercoat, the sonicated bath comprising an ultrasound bath having a frequency of from 20 to 45 KHz, and topcoating the object to form a topcoat, wherein the undercoat is selected to be equally noble or more noble than the topcoat.

2. The process according to claim 1 wherein the topcoating step is conducted using a process selected from the group consisting of electroless deposition, electroplating, brush plating, powder coating and a combination thereof.

3. The process according to claim 1 wherein the object is formed of a magnesium-based alloy.

4. The process according to claim 3 wherein the object is formed of an alloy selected from the group consisting of AZ91, AM60, AZ31, WE54, ZE63, ZK21, and ZM21.

5. The process of claim 1 wherein undercoat comprises Cu.

6. The process according to claim 1 wherein the frequency of from 20 to 45 KHz is induced in the ultrasound bath by vibrating the ultrasound bath container, by inserting a sonicating probe into the ultrasound bath, or by nesting the ultrasound bath wit a vibrating chamber.

7. The process according to claim 1 wherein the topcoat comprises a metal selected from the group consisting of Ni, Ti, Mn, Al, Fe, Co, Zr, Mo, Nb and W.

8. The process according to claim 1 wherein the topcoat is a metal alloy.

9. The process according to claim 1 wherein the topcoat is a metal composite.

10. The process according to claim 1 wherein topcoating comprises electroless deposition.

11. The process according to claim 1 wherein topcoating comprises electroplating.

12. The process according to claim 2 wherein the topcoating step comprises brush plating.

13. The process according to claim 2 wherein the topcoating step comprises powder coating.

14. The process according to claim 1 wherein the undercoat comprises a metal that is more noble than a metal comprising the topcoat.

15. The process according to claim 1 wherein the topcoat comprises an alloy.

16. The process according to claim 1 wherein the topcoat comprises a composite.

17. A process for coating an object formed of magnesium or a magnesium alloy comprising the steps of:

immersion coating the object in a sonicated bath to from an undercoat, said sonicated bath comprising an ultrasound bath having a frequency of from 20 to 45 KHz, and topcoating the object.

18. The process according to claim 17 wherein the topcoating step is conducted using a process selected from the group consisting of electroless deposition, electroplating, brush plating, powder coating and a combination thereof.

* * * * *

UNITED STATES PATENT AND TRADEMARK OFFICE

CERTIFICATE OF CORRECTION

PATENT NO. : 6,669,997 B2 
DATED : December 30, 2003
INVENTOR(S) : Ben Li Luan and Joy Elizabeth Gray It is certified that error appears in the above-identified patent and that said Letters Patent is hereby corrected as shown below:

Title page, Item [54] and Column 1, line 3,
Delete "ALLOY" and insert therefor -- ALLOYS --.

Signed and Sealed this

Sixteenth Day of March, 2004

JON W. DUDAS
*Acting Director of the United States Patent and Trademark Office*